United States Patent [19]

Wolverton

[11] 4,242,684

[45] Dec. 30, 1980

[54] QUICK DISCONNECT ANTENNA MOUNT

[76] Inventor: William D. Wolverton, 10320 Henderson Rd., Otisville, Mich. 48463

[21] Appl. No.: 57,273

[22] Filed: Jul. 13, 1979

[51] Int. Cl.[3] ..... H01Q 1/32

[52] U.S. Cl. ..... 343/715; 343/880

[58] Field of Search ..... 343/715, 900, 880, 882

[56] References Cited

U.S. PATENT DOCUMENTS

| | | | |
|---|---|---|---|
| 4,021,809 | 5/1977 | Klancnik | 343/900 |
| 4,047,779 | 9/1977 | Klancnik | 343/715 |

*Primary Examiner*—Eli Lieberman

*Attorney, Agent, or Firm*—Harry R. Dumont

[57] ABSTRACT

A mounting for antennas adapted for use on vehicles having mobile radio communications. The mounting device includes mating male and female members with connection provided by a straight push-in latch including a ball detent latch locked on downward pressure and disengaged by a single pull of a slip ring associated with the female member. The design of the male member allows it to be used as a stud assembly component in a plurality of mobile mounts such as mirrors, racks and the like. The special design modification of the female member further allows it to be used as an assembly component in a plurality of mobile antenna installations.

15 Claims, 9 Drawing Figures

FIG. 8
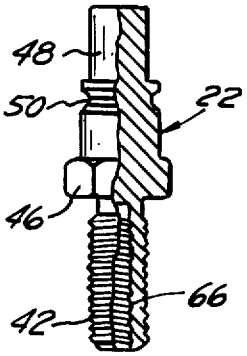
FIG. 7
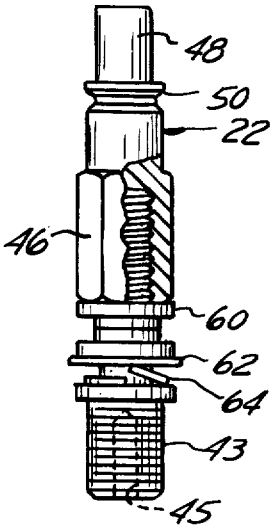
FIG. 6
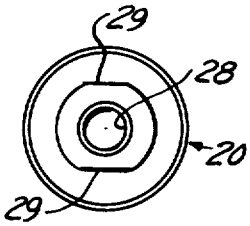
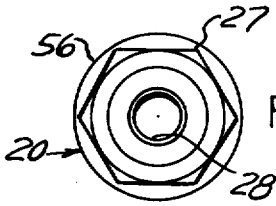
FIG. 4
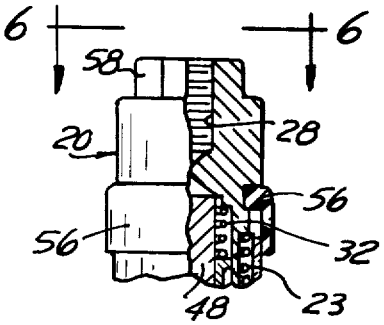
FIG. 5
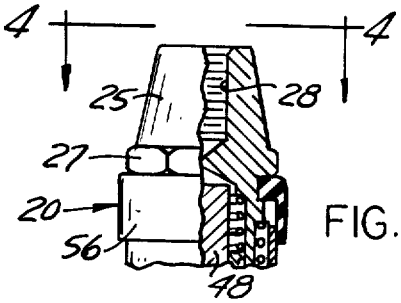
FIG. 3
FIG. 9
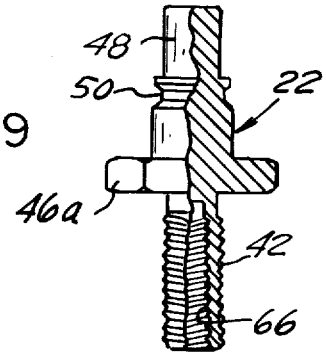

QUICK DISCONNECT ANTENNA MOUNT

BACKGROUND OF THE INVENTION

Prior art antenna quick disconnect mounting devices generally include a latch mechanism that operates by a bayonet latch principle with a push-in and turn latch and/or a push-in and turn action to remove the antenna. In many cases prealignment is necessary before the latch can be operated. Also, prior art disconnects generally are made of a tube design and require a core to lock into the tube. The outer diameter of the disconnect is approximately the same size as the antenna shaft.

The present invention provides a disconnect which overcomes the major problem with oxidation and electrical continuity present in the prior art devices. The present invention avoids the use of a through tube type female body assembly and in a novel manner incorporates an environmental seal to reduce the oxidation and corrosion problem.

The present invention further reduces the length of the disconnect and increases its strength. Installation problems are largely overcome by the incorporation of large hexagonal flats which allow for maximum tool contact on the disconnect operation. The enlarged hex flats reduce tool slippage and thus prevent disconnect damage during installation and removal by the user.

BRIEF SUMMARY OF THE PRESENT INVENTION

The present invention provides a mounting of a relaticely large diameter size to make the assembly heavier than other commercial products of its type. It further allows for a detent type locking mechanism of improved simplicity with respect to its operation. The locking operation is accomplished by simple push down of a female member.

BRIEF DESCRIPTION OF THE DRAWINGS

The present invention will now be described in the accompanying specification with reference to the accompanying drawings in which like numbers are used to refer to like parts where they occur in the different views and wherein;

FIGS. 3 and 4 are top and partial sectional views respectively of an alternate embodiment of the female member of FIG. 1;

FIGS. 5 and 6 are top and partial sectional views respectively of a still further embodiment of the female member of FIG. 1; and FIGS. 7, 8 and 9 are elevational views partly broken away illustrating still further embodiments of the male member used in the mounting device.

DETAILED DESCRIPTION OF THE SEVERAL EMBODIMENTS

Figure 1:
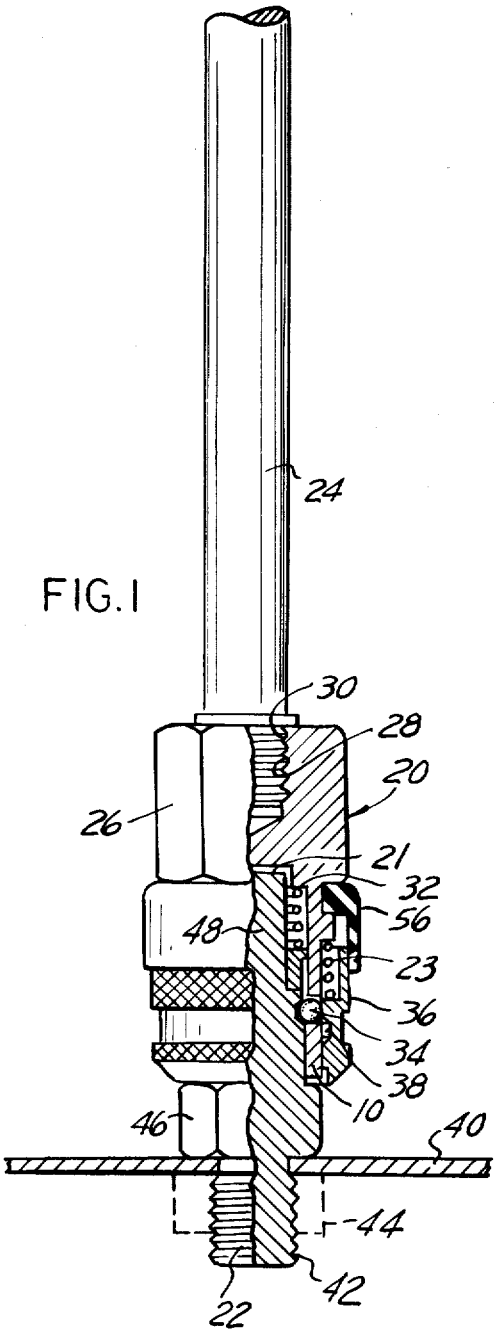
FIG. 1 is an elevational view partly in section showing an antenna and the disconnect device mounted in place on a sheet metal portion of a vehicle body.

FIG. 1 shows the three basic parts of the mounting device which are a female member 20, a male member 22 and an antenna 24.

The female member 20 includes an upper hexagonal configuration end portion 26. The female member 20 further includes at its upper end a central threaded opening 28 which threadably engages a mating lower threaded portion 30 of the antenna 24. Also included in the female member 20 is a group of elements which comprise the latching mechanism. These include springs 32 and 23 retained in an central opening 21 of the female member 20. A plurality of balls 34 generally four (4) in number are arranged circumferentially around the opening. Also included in the locking mechanism is a union sleeve 36 and a retainer or snap ring 10. It will be seen that upon operation of the female member 20 against the action of the springs 32 and 23, the balls 34 will be allowed to escape from the confining position with respect to the male member 22 so that the balls 34 will be displaced into a recess 38 formed in the union sleeve or slip ring 36 and it will be possible to remove the two parts including the antenna 24 and the female member 20. When it is necessary to reinstall the antenna, it is only necessary to fit the male and female parts together and push the female down over the mating male part. This operation will be made more clear from FIG. 2 hereinafter.

The male member 22 at its lower end is firmly attached to a piece of sheet metal of the vehicle body or mounting assembly identified by the numeral 40. This may be a part of the hood, trunk lid, fender of the vehicle or a suitable mounting assembly. To accomplish this attachment, the lower end of the male member 22 has a lower threaded portion 42. A lock nut 44 is used to tighten the mounting device into secure holding relationship with respect to the sheet metal part or mounting assembly 40. The male member 22 further includes a hexagonal cross section portion 46 and an upper cylindrical end 48 insertable in the central opening 21 formed in the female member 20 in the completion of the assembly. Also included in the male member 22 is a circumferential groove 50 used to confine the balls 34 during the latched condition of the assembly.

Figure 2:
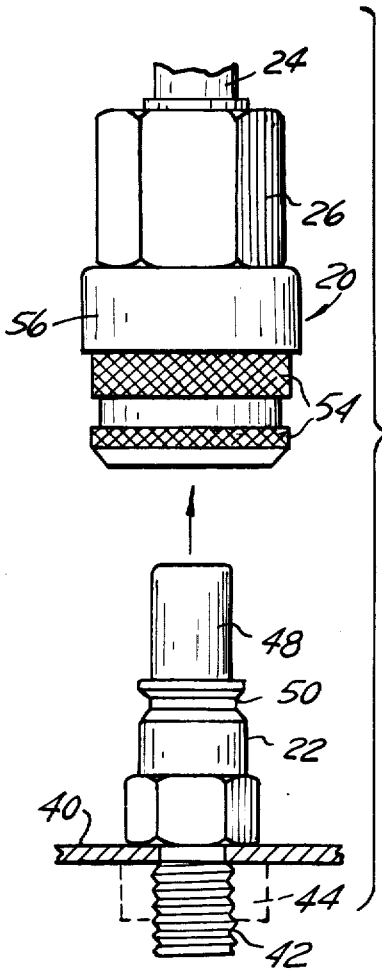
FIG. 2 is a spread perspective view showing the several parts of the FIG. 1 assembly.

FIG. 2 illustrates the peripheral knurled portion 54 provided about the body of the female member 20 to facilitate the manual gripping of the female member during the unlocking operation when an upward pressure is applied to the female member 20. Also included in the female member 20 is a downwardly oriented environmental shield 56.

FIGS. 3 and 4 show an alternate embodiment of the female member 20 in which the upper end of the member is tapered upwardly. The threaded opening 28 at the upper end of the female member 20 again is adapted to threadably engage a like contour thread at the lower end of the antenna 24. The tapered configuration of the upper end 25 of the female member 20 makes possible a more unitary type assembly of the female member 20 and the antenna 24 since the opening 28 can be made to substantially match the OD of the antenna 24. The embodiment of FIGS. 4 and 5 includes a hexagonal cross sectional portion 27 adapted to be gripped by a wrench for fastening and unfastening of the female member 20.

FIGS. 5 and 6 show a different embodiment of my invention in which the upper end of the female member 20 is provided with a narrowed end portion 58 that has a circular cross sectional configuration with two (2) substantially parallel flat sides 29 to allow for gripping by a tool such as a wrench for tightening or loosening the assembly. The general configuration of the end portion 58 is best shown in FIG. 6.

FIG. 7 shows a still different modification of the male member in which there is provided a relatively large hexagonal portion 46 which again allows for secure gripping by a tool when this is necessary. The large hexagonal portion 46 is tap threaded to take a bolt assembly as shown. The lower terminal end 43 may be formed with a cylindrical opening 45 as illustrated. The FIG. 7 modification includes a bolt assembly with a spacer 60, a flat washer 62 and a lock washer 64 to improve the holding action applied to a sheet metal part of the vehicle or to a mounting assembly, such as a coaxial electrical connector terminal end 43. The device of FIG. 8 includes a hexagonal portion 46 which is somewhat narrower than that of the corresponding part 46*a* in FIG. 9. It will be seen that a number of different embodiments of my invention are possible while using its basic teachings. The upper base of the female member 20 may be smooth for permanent antenna shaft attachment.

It will thus be seen that I have provided by my invention a mounting device for antennas which is adapted for providing a ready connect and disconnect operation to allow for removal of the antenna before travel through wooded terrain or when the vehicle is being left in a questionable area. The mounting device further is sturdier and more easily installed and operated than are prior art devices.

What is claimed is:

1. A quick disconnect mounting device for a vehicle-mounted antenna, comprising:

a male member and a female member, engagable one with the other, said male member operable to be fixed on a portion of the vehicle, said male member including a lower threaded end portion and an upper end portion operable to be seated in a central opening in one end of the female member, said female member having a threaded opening in its other end for receiving a like threaded end of the antenna, said central opening including a ball detent latch means and a slip ring mounted on and cooperable with said latch means; a first spring biasing means mounted intermediate said male and female member, a second spring biasing means mounted between said slip ring upper end and said female member, said latch means operable to lock the upper end portion of said male member on applied downward pressure and the slip ring operable against the force of said second biasing means for unlocking said upper end portion responsive to the upward pull of the snap ring, said first biasing means operable to separate said members with a strong force of separation.

2. The combination as set forth in claim 1 wherein said female member includes a relatively long hexagonal body proximate its upper end portion for ready engagement with a tool.

3. The combination as set forth in claim 1 wherein said female member includes a relatively short hexagonal body with a tapered end portion proximate its upper end portion.

4. The combination as set forth in claim 1 wherein said female member includes narrowed body portion having a pair of substantially parallel flat sides proximate its upper end portion.

5. The combination as set forth in claim 1 wherein a downwardly oriented dust seal is mounted centrally about said female member.

6. The combination as set forth in claim 1 wherein the central portion of said female member includes a knurled periphery for facility of lock and unlock operation.

7. The combination as set forth in claim 1 wherein said lower threaded portion of said male member includes an internally threaded opening for attaching an electrical connector thereto.

8. The combination as set forth in claim 1 wherein said lower threaded portion of said male member includes a spacer and a washer for engaging a sheet metal portion of the vehicle therebetween in firm holding relationship.

9. The combination as set forth in claim 8 wherein there is included in said male member a relatively long central portion of hexagonal cross section.

10. The combination as set forth in claim 1 wherein there is included in said male member a relatively short central portion of hexagonal cross section.

11. The combination as set forth in claim 1 wherein said lower threaded portion of said male member includes a spacer and a washer for engaging a mounting assembly fixed to said vehicle therebetween in firm holding relationship.

12. A quick disconnect mounting device for a vehicle mounted antenna, comprising:

a male member and a female member, engagable one with the other, said male member operable to be fixed to a part of the vehicle, said male member including a lower threaded end portion and an upper cylindrical end portion operable to be gripped in a central opening in the lower end of the female member, said female member having a threaded opening in its upper end for receiving a like threaded end of the antenna, said central opening of said female member including a ball detent latch means operable to lock the upper end portion of the male member on applied downward pressure of the female member, and a slip ring device operable to unlock the upper end portion of the male member responsive to applied upward pull of the slip ring and the female member, a first biasing means connected inermediate said male and female members and a second biasing means connected between said slip ring and said female member.

13. The combination as set forth in claim 12 wherein the female member and the male member each include a relatively long hexagonal body for ready engagement with a tool.

14. The combination as set forth in claim 12 wherein the female member includes a relatively narrowed body portion having a pair of substantially parallel flat sides proximate its upper end portion.

15. The combination as set forth in claim 12 wherein a downwardly oriented environmental seal is mounted centrally about said female member.

* * * * *